US010900642B2

(12) United States Patent
Green et al.

(10) Patent No.: US 10,900,642 B2
(45) Date of Patent: Jan. 26, 2021

(54) LUMINAIRE TRIM ATTACHMENT MECHANISM AND MOUNTING BRACKET ATTACHMENT MECHANISM

(71) Applicant: SIGNIFY HOLDING B.V., Eindhoven (NL)

(72) Inventors: Russell Bryant Green, Douglasville, GA (US); Hao Luo, Xiamen (CN); Huitang Zhang, Xiamen (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/404,634

(22) Filed: May 6, 2019

(65) Prior Publication Data

US 2019/0338925 A1 Nov. 7, 2019

Related U.S. Application Data

(60) Provisional application No. 62/667,310, filed on May 4, 2018.

(51) Int. Cl.

| | |
|---|---|
| ***F21V 17/00*** | (2006.01) |
| ***F21V 21/04*** | (2006.01) |
| ***F21S 8/02*** | (2006.01) |

(52) U.S. Cl.
CPC ..... *F21V 17/002* (2013.01); *F21S 8/026* (2013.01); *F21V 21/049* (2013.01)

(58) Field of Classification Search
None
See application file for complete search history.

(56) References Cited

U.S. PATENT DOCUMENTS

| | | | | |
|---|---|---|---|---|
| 10,018,336 | B2 * | 7/2018 | Germain | F21V 21/046 |
| 2017/0009963 | A1 * | 1/2017 | Germain | F21V 21/042 |

* cited by examiner

*Primary Examiner* — Vip Patel

(57) ABSTRACT

A luminaire includes a light module body and a trim attachment mechanism. The trim attachment mechanism includes a first lever with a first cam on a first side of the light module body and a second lever with a second cam on a second side of the light module body. The first lever and the second lever can both be rotated between a release position that releases and attached trim and an engage position that engages an attached trim. The luminaire can also include a mounting bracket mechanism with a recess circumscribing the light module body and a pair of notches on opposite sides. Torsion spring brackets can be shaped to rotate freely in the recess, whereas friction blade brackets are secured in the notches so that the friction blades do not rotate relative to the light module body.

20 Claims, 5 Drawing Sheets

LUMINAIRE TRIM ATTACHMENT MECHANISM AND MOUNTING BRACKET ATTACHMENT MECHANISM

RELATED APPLICATIONS

The present application claims priority to U.S. Provisional Patent Application No. 62/667,310 filed May 4, 2018 and titled "Luminaire Trim Attachment Mechanism and Mounting Bracket Attachment Mechanism," the entire contents of which are incorporated herein by reference.

TECHNICAL FIELD

Embodiments of the technology relate generally to illumination systems and more particularly to attaching a trim to a luminaire and attaching mounting brackets to a luminaire.

BACKGROUND

Luminaires often have a trim (also referred to as a finishing section) that is attached to the luminaire. This is particularly true for luminaires recessed into a ceiling as the trim covers any gaps between the recessed luminaire and the ceiling and provides an improved appearance. Trims can also include a reflector that is used to direct light exiting the luminaire. A simpler method for attaching a trim to a luminaire would be beneficial. A simpler attachment mechanism also would allow one to more easily replace a trim attached to a luminaire with another trim of a different color or style. An improved mechanism for attaching mounting brackets to permit aligning recessed luminaires when they are installed in a ceiling would also be beneficial.

SUMMARY

In one example embodiment, the present disclosure provides a luminaire with a trim attachment mechanism for easily detaching and reattaching trims to a recessed luminaire. The luminaire comprises a light module body with an open bottom end configured to emit light. The light module body has a first lever with a first cam and a second lever with a second cam. The first lever can rotate the first cam between a first release position and a first engage position. Similarly, the second lever can rotate the second cam between a second release position and a second engage position. As such, the first lever and the second lever can be rotated to release or engage a trim located at the open bottom end of the luminaire. For example, the trim can have a first post and a second post wherein when the trim is placed adjacent the open bottom end of the luminaire the first cam engages the first post and the second cam engages the second post thereby securing the trim to the luminaire.

In another embodiment, the disclosure provides a luminaire with a bracket attachment mechanism that accommodates different types of retention brackets. A recessed luminaire can comprise a light module body with an open bottom end to emit light and a recess circumscribing the light module body, the recess comprising a first notch and a second notch. The first and second notches can be located on opposite sides of the light module body. In a first installation mode, the recess is configured to receive a pair of torsion spring brackets so that the pair of torsion spring brackets can rotate within the recess. Permitting the torsion spring brackets to rotate within the recess allows the light module body and an attached trim to be rotated for alignment when the torsion spring brackets and torsion springs are locked in place within a recessed housing. In contrast, in a second installation mode, the recess is configured to receive a first friction blade bracket that fits within the first notch and the recess is configured to receive a second friction blade bracket that fits within the second notch. Fitting the friction blade brackets within the notches locks the friction blade brackets in place so that the friction blade brackets and the light module body do not rotate relative to each other once the luminaire is inserted and rotated within the recessed housing.

In yet another example embodiment, the disclosure provides a luminaire with a bracket attachment mechanism that permits rotation. A recessed luminaire can comprise a light module body with an open bottom end to emit light and a recess circumscribing the light module body. A top bracket is rotatably attached to a top of the light module body and first and second torsion spring brackets are attached to the top bracket. The first torsion spring bracket comprises a first foot that slides within the recess and the second torsion spring bracket comprises a second foot that slides within the recess. The arrangement of the slidable first foot and second foot within the recess and the rotatable top bracket permits rotation of the light module with respect to the torsion spring brackets after the light module and torsion spring brackets are installed in a recessed housing and the torsion spring brackets are locked into place with torsion springs placed in torsion spring receivers within the recessed housing. Rotation of the light module after installation in the recessed housing permits alignment of the light module and attached trim with other nearby light modules or features.

These and other aspects and embodiments will be apparent upon reviewing the following detailed description and claims and the accompanying drawings.

BRIEF DESCRIPTION OF THE FIGURES

Reference will be made below to the accompanying drawings.

Figure 1:
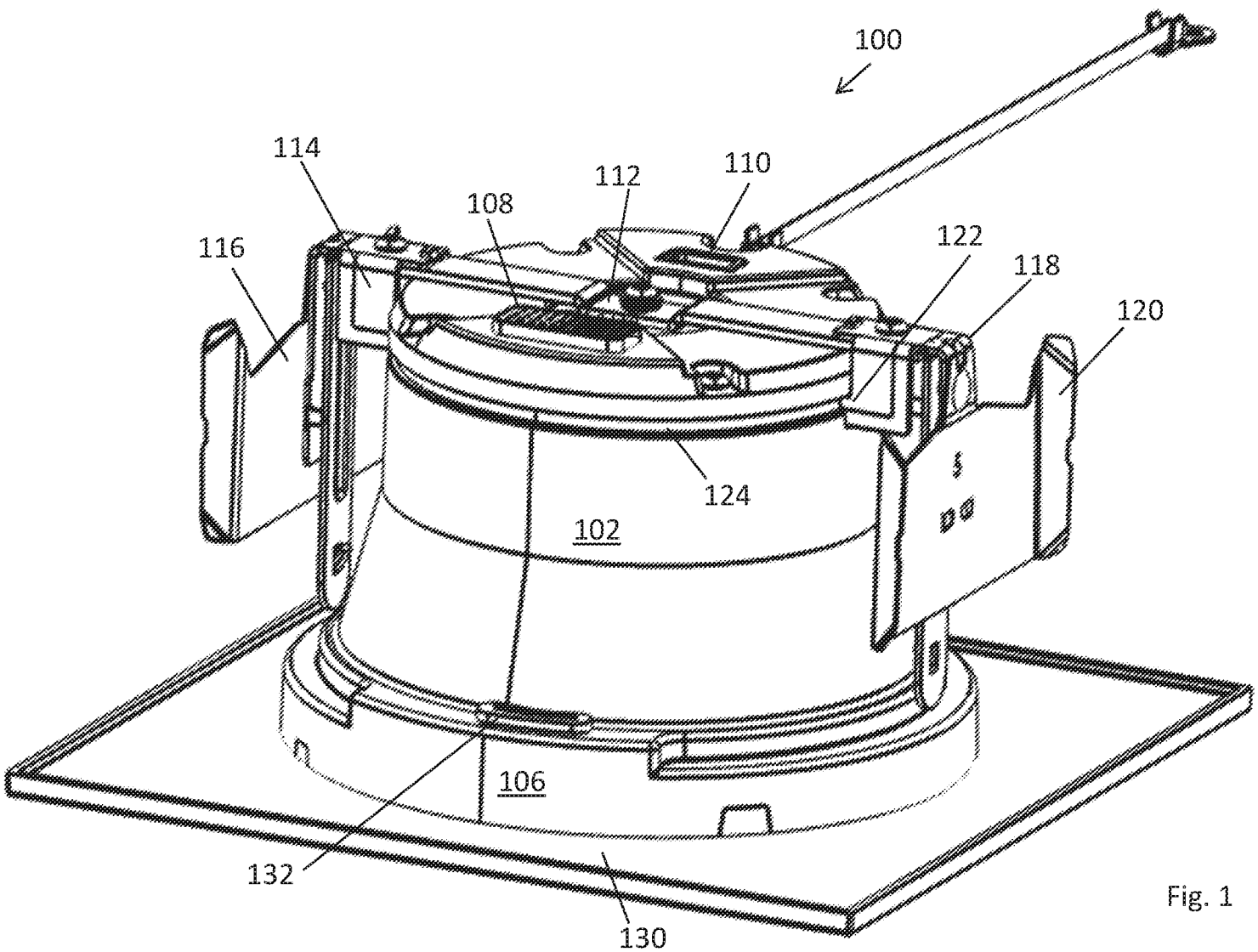
FIG. 1 is a top perspective view of a luminaire with an attached trim in accordance with an example embodiment of the disclosure.

The drawings illustrate only example embodiments and are therefore not to be considered limiting of the embodiments described, as other equally effective embodiments are within the scope of this disclosure. The elements and features shown in the drawings are not necessarily drawn to scale, emphasis instead being placed upon clearly illustrating principles of the embodiments. Additionally, certain dimensions or positions may be exaggerated to help visually convey certain principles. In the drawings, similar reference numerals among different figures designate like or corresponding, but not necessarily identical, elements.

DETAILED DESCRIPTION OF EXAMPLE EMBODIMENTS

The example luminaires described herein provide an attachment mechanism for attaching and detaching a trim to and from a light module body. The attachment mechanism is particularly useful for recessed luminaires that typically employ a trim. The attachment mechanism allows a person to easily attach a trim to the light module body. The attachment mechanism also allows a person to easily detach a trim from a light module so that the trim can be replaced with another trim of a different style or color.

The example luminaires described herein also provide a mounting bracket mechanism to facilitate use of different types of mounting brackets with the luminaire. Mounting brackets are typically used in a recessed luminaire to affix the light module portion of the luminaire within a housing in a ceiling, such as a cylindrical housing can.

In a first installation mode, when torsion spring brackets with torsion springs are used with a recessed luminaire, the ends of the torsion springs are received in torsion spring receivers within the housing. The torsion spring receivers lock the torsion springs and their attached torsion spring brackets into place. However, it is beneficial to be able to rotate the light module body relative the affixed torsion spring brackets so that the light module body and trim can be aligned with other luminaires or nearby walls. For example, square trims attached to adjacent luminaires that are misaligned can be an aesthetic problem.

Because the torsion spring receivers in the recessed housing lock the torsion springs and the torsion spring brackets into place, it is not possible to rotate the light module and trim once the light module is installed in the recessed housing of a conventional luminaire. However, the torsion spring brackets of the example luminaires described herein have a foot feature that fits and slides within a recess circumscribing the light module body so that the light module body can rotate relative to the torsion spring brackets when the torsion spring brackets are affixed in the receivers of the housing.

In a second installation mode, friction blade brackets are used instead of torsion spring brackets. Unlike torsion spring brackets, friction blades and friction blade brackets are not locked into place by receivers within the recessed housing. Therefore, the light module, the trim, and the friction blade brackets and friction blades can be rotated together to the desired orientation before insertion into the recessed housing. In other words, the light module, trim, and the friction blade brackets and friction blades can be rotated to align with nearby luminaires or other features and then once the light module and the attached components are in the aligned orientation they are pushed into the recessed housing. Because the light module and the attached friction blades are aligned at the time they are inserted into the recessed housing, it is beneficial if the light module body does not rotate relative to the friction blade brackets after they have been inserted into the recessed housing. The mounting bracket mechanism of the example luminaires described herein can address this need by including notches in the recess circumscribing the light module body. In contrast to the foot feature of the torsion spring brackets described in the first installation mode, the foot feature on the friction blade mounting brackets is longer and thereby engages the notches in the recess so that the friction blade mounting brackets do not rotate relative to the light module body. The foregoing features will now be described further with reference to the figures.

Referring now to FIGS. 1, 2, 3, and 5, an example recessed luminaire 100 is illustrated. The recessed luminaire 100 comprises a light module body 102 and a light module top 104. The light module body 102 and the light module top 104 can be referred to together as the light module and in certain alternate embodiments they may constitute a single integrated component as opposed to two separable components. The light module top 104 includes a top bracket 112 to which are attached a first friction blade bracket 114 with a first friction blade 116 and a second friction blade bracket 118 with a second friction blade 120. The top bracket 112 is secured to the light module top 104 so that it can rotate. The light module top 104 of the example recessed luminaire 100 also includes a connector 110 for receiving an electrical cable and a correlated color temperature selector switch 108 for selecting different color temperatures of light to be emitted from the recessed luminaire 100. Within the recessed luminaire are a light source oriented to emit light toward the bottom open portion of the light module body 102, a reflector 162 to guide light toward the bottom open portion of the light module body 102, and a lens 160.

Figure 3:
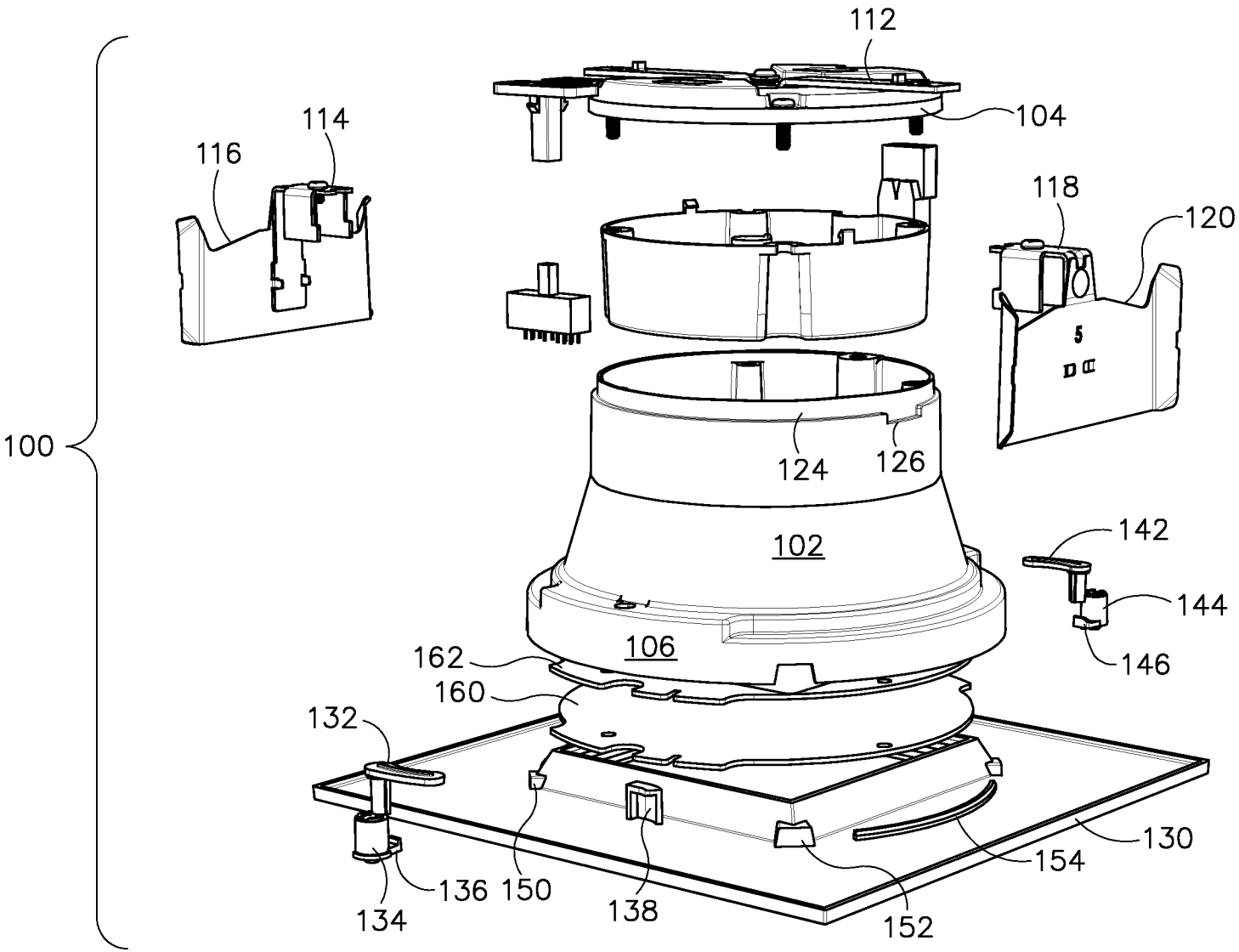
FIG. 3 is another exploded top perspective view of the luminaire and trim of FIG. 1 in accordance with an example embodiment of the disclosure.

Two trim attachment mechanisms that are substantially identical are located on opposite sides of the recessed luminaire 100 along a bottom portion 106 of the light module body 102. The first trim attachment mechanism includes a cam 136 with a cam shaft 134 and a lever 132 that fits within the cam shaft 134. The lever 132 sits on a ledge on the bottom portion 106 of the light module body 102 and a shaft portion of the lever 132 passes through an aperture in the ledge. In certain embodiments, a flexible washer can be placed between the lever 132 and the ledge to facilitate smooth motion of the lever and smooth interaction of the cam with the trim. The cam 136 and cam shaft 134 are located inside the bottom portion 106 and below the ledge of the light module body 102. As illustrated in FIG. 3, the reflector 162 and the lens 160 have cutouts along their periphery to accommodate the cam shaft 134. The lever 132 can be rotated by a person so that the cam 136 moves between an engage position and a release position. In the engage position shown in FIG. 5, the lever 132 is turned inward and the cam 136 rotates to engage a first post 138 attached to a trim 130. In a release position, the lever 132 is turned outward and the cam 136 disengages from the post 138 so that the trim is released from the light module body 102. On the opposite side of the light module, a second lever 142, second cam shaft 144, and second cam 146 operate in a similar manner to engage and release from a second post located on the opposite side of the trim 130 from the first post 138.

Figure 6:
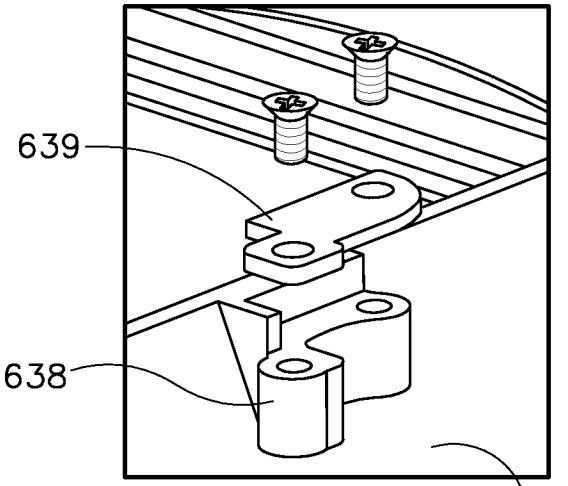
FIGS. 6, 7, and 8 are enlarged views of a trim attachment mechanism in accordance with another example embodiment of the disclosure.
Figure 8:
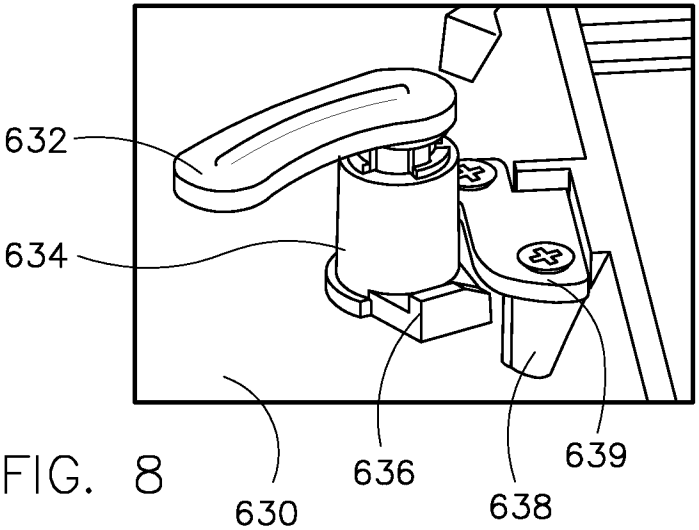
Figure 5:
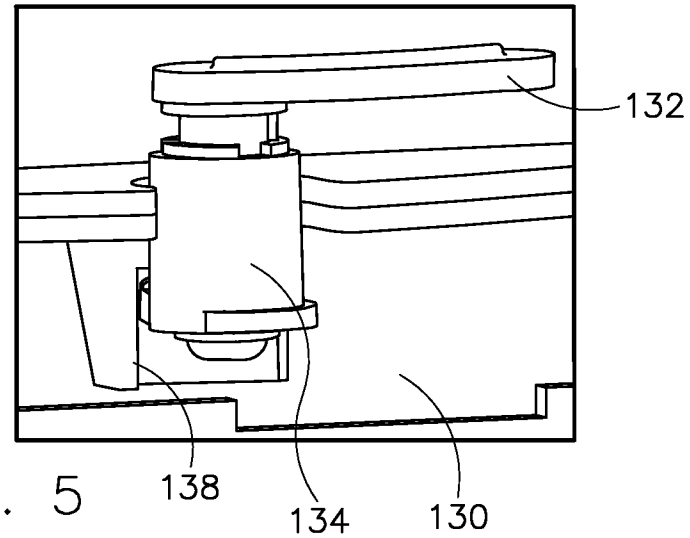
FIG. 5 is an enlarged view of a trim attachment mechanism in accordance with an example embodiment of the disclosure.
Figure 7:
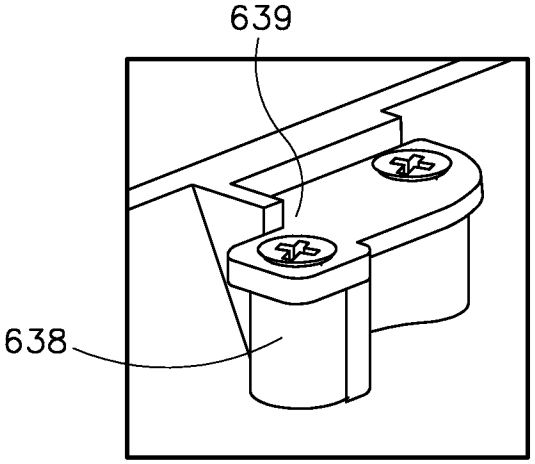

The first post 138 shown in FIGS. 3 and 5 comprises a top portion and a cavity into which the first cam 136 rotates and engages the first post 138. It should be understood the configuration of the post can vary in other embodiments. For example, the first post 138 shown in FIGS. 3 and 5 is a single piece that is molded integrally with the trim 130. However, FIGS. 6-8 illustrate an alternate embodiment wherein a top plate 639 is a separate component that is fastened to the post 638. FIG. 8 illustrates the alternate trim attachment mechanism in the release position with the lever 632 and the cam 636 rotated outward. The post 638 is attached to the trim 630 so that the top plate 639 and the post 638 form a cavity into which cam 636 rotates when lever 632 rotates cam shaft 634 and the cam 636 inward. In yet other embodiments, the cam and the post can take other forms such as an hourglass shape.

The trim attachment mechanism allows a person to easily remove attached trim 130 by turning the first lever 132 and the second lever 142 outward and away from the light module body 102 so that the first and second cams 136 and 146 are in a release position. Once the trim 130 is removed, a second trim can then be easily attached by placing the second trim adjacent to the bottom open end of the light module body 102 so that the posts of the second trim are inserted into the bottom portion 106 of the light module body 102 and then turning the first lever 132 and the second lever 142 inward so that the first cam 136 and the second cam 146 are in the engage position engaging the posts of the second trim.

Other optional features on the trim 130 can also assist with removing and attaching trims. For example, trim 130 shown in FIGS. 2 and 3 includes an alignment rib 154 and an alignment tabs 150 and 152. Alignment rib 154 is shaped to be received by an inside surface of the bottom portion 106 of the light module body 102. Similarly, alignment tabs 150 and 152 are shaped to fit into recesses in the bottom portion 106 of the light module body 102. In the example shown in FIG. 3, the alignment tabs 150 and 152 have different sizes so that the trim can only be attached to the light module body 102 in the correct orientation with the first post 138 aligned with the first lever 132. In other words, the trim 130 will not fit against the light module 102 if the trim 130 is turned 90 degrees where the alignment tabs 150 and 152 will not fit into the cutouts in the light module 102 and the first post 138 will not align with the first lever 132. In some embodiments, both the alignment rib 154 and the alignment tabs 150 and 152 can be present on the trim, whereas in other embodiments only one of the features or none of the features may be present.

Figure 2:
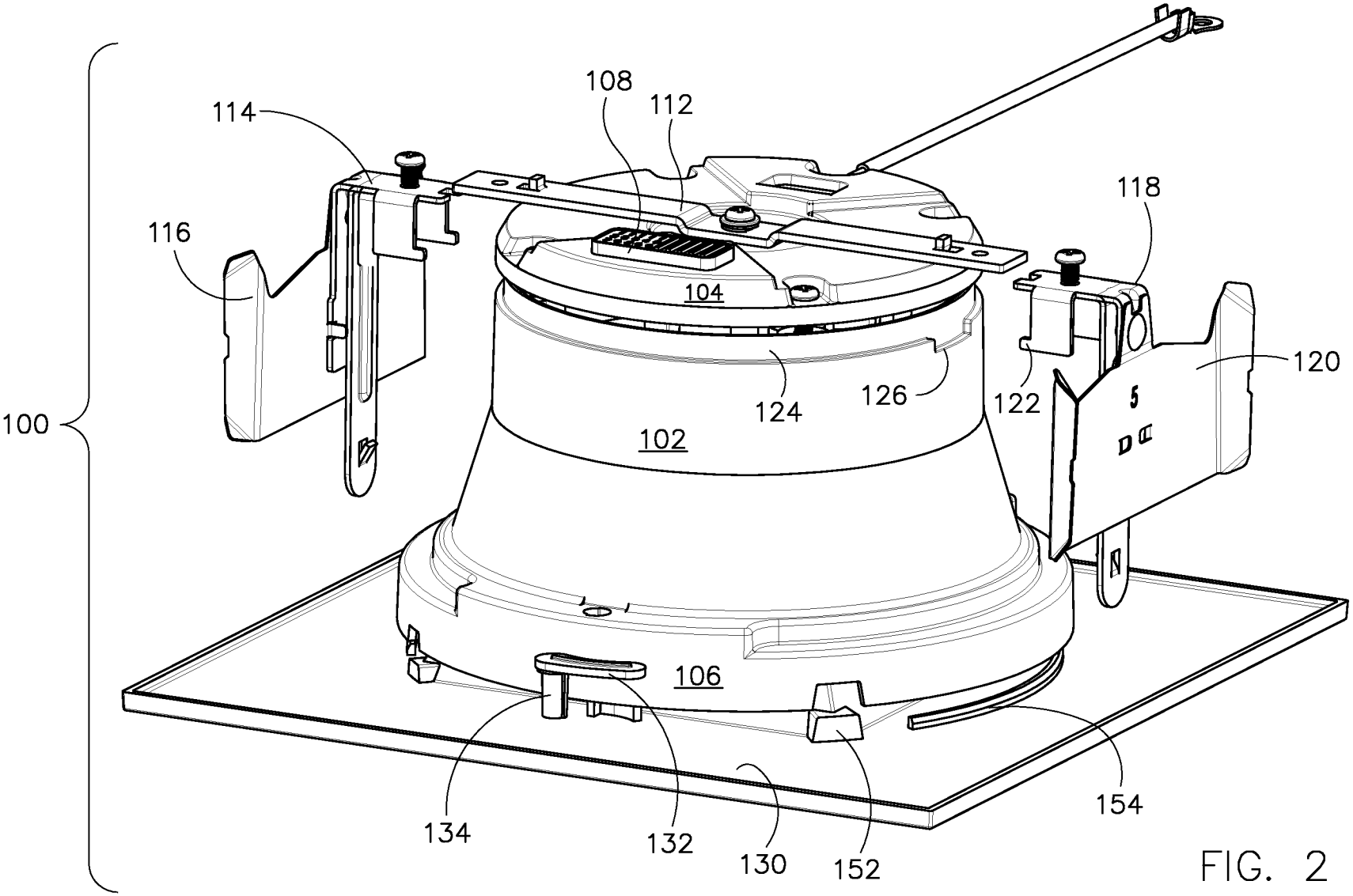
FIG. 2 is an exploded top perspective view of the luminaire with the trim of FIG. 1 in accordance with an example embodiment of the disclosure.

Referring again to FIGS. 1 and 2, the mounting bracket mechanism can be described in further detail. The example recessed luminaire 100 shown in FIGS. 1 and 2 includes friction blade brackets 114 and 118 attached to the top bracket 112 in accordance with the previously described second installation mode. The first and second friction blade brackets 114 and 118 include a foot portion 122 that is long enough to fit into notches 126 on opposite sides of the light module body 102. Because the foot portion 122 of each friction blade bracket 114 and 118 fits into the notches 126, the friction blade brackets are not able to rotate in the recess 124 that circumscribes the light module body 102. As described above, it is desirable for the friction blade brackets to remain stationary relative to the light module body 102 when installing the recessed luminaire 100 in a recessed housing. While the recess 124 is shown in FIGS. 1 and 2 at the top of the light module body 102 and adjacent the light module top 104, it should be understood that in alternate embodiments the recess 124 can be located at other heights along the light module body 102 or along the light module top 104.

Figure 4:
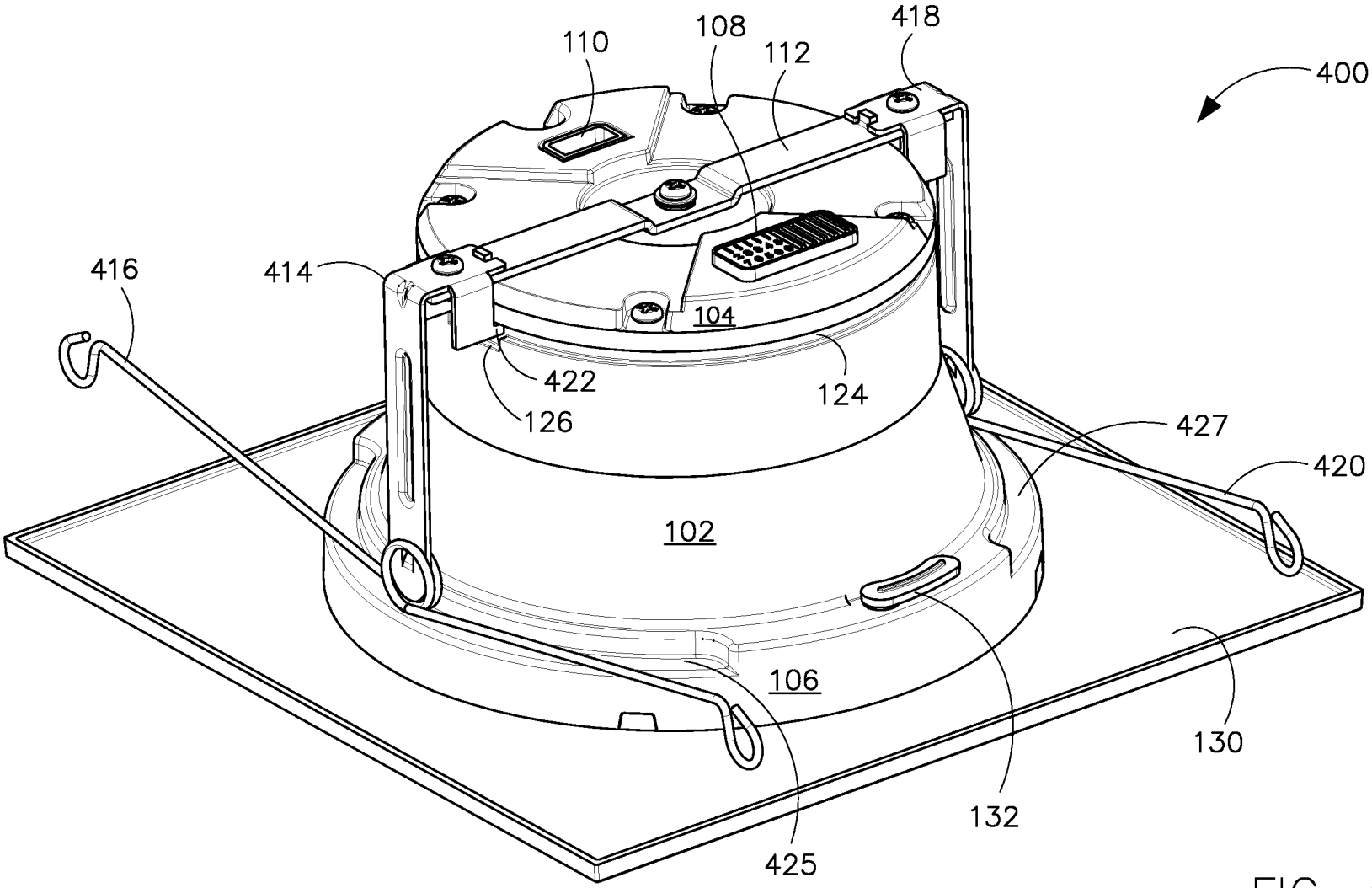
FIG. 4 is a top perspective view of a luminaire with an attached trim in accordance with another example embodiment of the disclosure.

In contrast, FIG. 4 shows an alternate embodiment with recessed luminaire 400. Recessed luminaire 400 includes many of the same components as recessed luminaire 100 and their descriptions will not be repeated. Recessed luminaire 400 is distinct in that, instead of friction blade brackets, it has torsion spring brackets 414 and 418 with respective torsion springs 416 and 420 in accordance with the first installation mode described above. Torsion spring brackets 414 and 418 comprise a relatively shorter foot portion 422 (or a cutout in the foot portion 422) that does not reach notches 126 on each side of the light module body 102. Therefore, the foot portion 422 of each torsion spring bracket 414 and 418 is free to slide in the recess 124 circumscribing the light module body 102. The effect of the freedom of the torsion spring brackets 414 and 418 to slide in the recess 124 is that the light module can rotate relative to the torsion spring brackets after the torsion spring brackets and torsion springs are locked into the respective receivers in the recessed housing. As described above, it is beneficial during installation of the recessed luminaire 400 to be able to rotate the light module body 102 relative to the torsion spring brackets that are fixed in the receivers of the recessed housing so that the light module body 102 and the attached trim can be aligned with nearby luminaires, walls or other features.

Representative embodiments have been described herein with reference to the accompanying drawings that illustrate embodiments of the technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Any example luminaires, or components thereof, described herein can be made from a single piece (e.g., as from a mold, injection mold, die cast, 3-D printing process, extrusion process, stamping process, or other prototype methods). In addition, or in the alternative, an example luminaire (or components thereof) can be made from multiple pieces that are mechanically coupled to each other. In such a case, the multiple pieces can be mechanically coupled to each other using one or more of a number of coupling methods, including but not limited to epoxy, welding, soldering, etching, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example luminaire to become coupled, directly or indirectly, to another portion of the example luminaire and/or some external component (e.g., a wall, a ceiling). A coupling feature can include, but is not limited to, a snap, a clamp, a portion of a hinge, an aperture, a recessed area, a protrusion, a slot, a spring clip, a tab, a detent, and mating threads. One portion of an example luminaire can be coupled to another component of the example luminaire or an external component by the direct use of one or more coupling features.

In addition, or in the alternative, a portion of an example luminaire can be coupled to another portion of the luminaire or another component using one or more independent devices that interact with one or more coupling features disposed on the example luminaire. Examples of such devices can include, but are not limited to, a pin, a hinge, a fastening device (e.g., a bolt, a screw, a rivet), epoxy, a sealing member (e.g., an O-ring, a gasket), glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a light module body, the light module body comprising an open bottom end oriented to emit light;

a first lever disposed on a first side of the light module body and a second lever disposed on a second side of the light module body; and a first cam attached to the first lever and a second cam attached to the second lever, wherein the first cam is rotatable, by the first lever, between a first release position and a first engage position and the second cam is rotatable, by the second lever, between a second release position and a second engage position.

2. The luminaire of claim 1, wherein in the first engage position, the first cam engages a first post on a trim positioned adjacent to the open bottom end of the light module body, and in the second engage position, the second cam engages a second post on the trim.

3. The luminaire of claim 2, wherein the first post comprises a first top and a first cavity; and the second post comprises a second top and a second cavity.

4. The luminaire of claim 2, wherein the trim comprises at least one of:

a trim alignment rib; and a trim alignment tab.

5. The luminaire of claim 1, wherein the first side and the second side are opposite each other on the light module body.

6. The luminaire of claim 1, wherein in the first release position, the first cam is released from a first post on a trim positioned adjacent to the open bottom end of the light module body; and in the second release position, the second cam is released from a second post on the trim.

7. The luminaire of claim 1, wherein the first cam comprises a first cam shaft and the first lever comprises a first lever shaft that is attached to the first cam shaft; and the second cam comprises a second cam shaft and the second lever comprises a second lever shaft that is attached to the second cam shaft.

8. The luminaire of claim 1, wherein the first lever and the second lever are positioned on a ledge of the light module body.

9. The luminaire of claim 8, wherein a bottom portion of the light module body comprises:

the ledge and a recess to accommodate a retention bracket.

10. A recessed luminaire comprising:

a light module body, the light module body comprising an open bottom end oriented to emit light; and a recess circumscribing the light module body, the recess comprising a first notch and a second notch, the first and second notches on opposite sides of the light module body, wherein, in a first installation mode, the recess is configured to receive a pair of torsion spring brackets so that the pair of torsion spring brackets can rotate within the recess, and wherein, in a second installation mode, the recess is configured to receive a first friction blade bracket that fits within the first notch and the recess is configured to receive a second friction blade bracket that fits within the second notch.

11. The recessed luminaire of claim 10, wherein the pair of torsion spring brackets each has a foot portion that is shorter than a foot portion of the first friction blade bracket and the second friction blade bracket so that the foot portion of the pair of torsion spring brackets does not engage the first notch and the second notch.

12. The recessed luminaire of claim 10, wherein, in the first installation mode, the pair of torsion spring brackets can rotate in the recess so that the recessed luminaire can be aligned when installed in a ceiling.

13. The recessed luminaire of claim 10, wherein, in the second installation mode, the first friction blade bracket cannot rotate in the recess and the second friction blade bracket cannot rotate in the recess.

14. The recessed luminaire of claim 10, further comprising a top bracket disposed on a top surface of the light module body, the top bracket configured to receive the pair of torsion spring brackets when in the first installation mode and the first and second friction blade brackets when in the second installation mode.

15. The recessed luminaire of claim 10, wherein the light module body further comprises:

a ledge proximate to the open bottom end of the light module body, wherein ledge comprises at least one recess so that the ledge does not contact a pair of torsion springs attached to the pair of torsion spring brackets.

16. A recessed luminaire comprising:

a light module body, the light module body comprising an open bottom end oriented to emit light;

a recess circumscribing the light module body;

a top bracket attached to a top of the light module body;

a first torsion spring bracket attached to the top bracket, the first torsion spring bracket comprising a first foot that rotates within the recess; and a second torsion spring bracket attached to the top bracket, the second torsion spring bracket comprising a second foot that rotates within the recess.

17. The recessed luminaire of claim 16, wherein the first torsion spring bracket and the second torsion spring bracket are disposed on opposite sides of the light module body.

18. The recessed luminaire of claim 16, further comprising:

a first torsion spring attached to the first torsion spring bracket; and a second torsion spring attached to the second torsion spring bracket.

19. The recessed luminaire of claim 18, wherein after installation of the light module body and the first and second torsion springs in a recessed housing, the light module body is rotatable relative to the first and second torsion springs to permit alignment of the light module body.

20. The recessed luminaire of claim 16, wherein the top bracket is rotatable after it is attached to the top of the light module body.

* * * * *